United States Patent [19]

Kim

[11] Patent Number: 4,977,724

[45] Date of Patent: Dec. 18, 1990

[54] HEAT SEALED DISPOSABLE PAINT BAG AND METHOD

[76] Inventor: Dae S. Kim, 1178 Walnut St., Newton, Mass. 02161

[21] Appl. No.: 388,575

[22] Filed: Aug. 1, 1989

[51] Int. Cl.[5] ..... B65B 43/08

[52] U.S. Cl. ..... 53/456; 53/171; 53/562; 493/934

[58] Field of Search ..... 53/456, 455, 460, 449, 53/171, 562, 568; 493/934, 100

[56] References Cited

U.S. PATENT DOCUMENTS

| | | | |
|---|---|---|---|
| 2,908,383 | 10/1959 | Vogt | 53/456 X |
| 3,282,411 | 11/1966 | Jardine | 53/456 X |
| 3,411,264 | 11/1968 | Farquhar | 53/456 |
| 3,967,772 | 7/1976 | Baker | 53/456 X |
| 4,216,639 | 8/1980 | Gautier | 53/455 X |
| 4,813,208 | 3/1989 | Piltz et al. | 53/456 X |

*Primary Examiner*—James F. Coan

*Attorney, Agent, or Firm*—William Nitkin

[57] ABSTRACT

Trapezoidal sections are simultaneously heat sealed and cut from a long strip of sheet plastic folded over double or in tubular form. Cutting one long corner and inserting air opens the interior volume of the trapezoid. Crimping the long ends horizontally, with the trapezoidal plane held vertically, and heat sealing one bottom end forms a tent-shaped bag. The paint bags are placed in a molded tote tray and gang filled through the cut ends and a number of the cut ends heat sealed simultaneously by a bar sealer. The molded tote tray is also used to transport and display the paint bags. Each paint bag fits into a paint applicator having a tent-shaped receiving space directly contacting a paint pad with multiple holes. The paint bag is punctured and squeezed to supply paint continuously to the pad through the holes. A tubular sheet of plastic creates disposable paint bags filled through one of the bottom ends before sealing. Folded over plastic sheets create open-topped refillable paint bags.

4 Claims, 1 Drawing Sheet

HEAT SEALED DISPOSABLE PAINT BAG AND METHOD

BACKGROUND OF THE INVENTION

1. Technical Field

The present invention relates to containers for paint and in particular to a heat sealed plastic disposable paint bag and a method for making the same.

2. Description of the Prior Art

Most prior art painting devices require constant recharging of the painting implement with paint, wasting considerable time. With most paint containers there is a messy process involved in transferring the paint from the container to the paint applicator with substantial cleanup involved wasting time and energy.

Most prior art self-contained paint supply devices require filling the apparatus with paint and require a substantial amount of cleaning to wash out the container. The cleaning of the paint applicator system generally involves substantial time and effort and is the most annoying aspect of the painting chore. Cleaning generally requires the use of organic solvent for oil base paints or soapy water for water base latex paints. The spent solvent is usually disposed into the sewer system, which results in a higher B.O.D. (biological oxygen demand) for sewage treatment. Also, a substantial quantity of solvent is released into the atmosphere through evaporation. In addition, some paints contain fungicidal and germicidal compounds which tend to harm common biological sewage treatment processes while they additionally increase the B.O.D.

Prior art painting containers for large painting jobs are normally very heavy cans containing a substantial amount of paint. Very often a portion of the paint is left over and saved for "touch up" later. This creates a storage problem because the large cans are usually covered with drippings of the paint and a danger of leaking if the cans are tipped over. There is a health hazard from the fumes and potential danger of explosion if stored in a hot place.

Paint cans are a cylindrical shape and waste considerable space when stored side by side because two cans only touch at one point and the remaining space between the cans is empty. To a store shelf space is very valuable and in homes storage space is usually at a premium, especially in apartments or condominiums.

DISCLOSURE OF INVENTION

By providing a plastic bag filled with paint to be inserted in a painting apparatus for a contant feed of paint to the paint applicator, considerable time is saved by not having to recharge the applicator with paint constantly. The sealed paint bag slips into the paint apparatus with no mess thereby saving considerable clean up time.

Because each paint bag is completely self-contained and is inserted directly into the paint applicator, the spent bags are thrown away and there is no mess to clean up after painting, thereby saving time and eliminating any hazardous waste which might otherwise be poured into the sewage treatment system.

Filling each paint bag with about an eighth of a gallon of paint maintains a relatively lightweight painting apparatus even with a full bag of paint, while allowing a substantial amount of surface to be covered (approximately 50 square feet) with each full bag. The quantity of paint in the bag would be used up in one application, thereby not having any storage problem or health hazard because there would be no partly filled containers to store.

Providing a molded plastic tote tray for gang filling, heat bar sealing, carrying and storing 28 closely packed paint bags in form fitting spaces saves time in manufacturing and space on storage and display shelves while providing a convenient means for carrying a substantial amount of paint easily with handles on each tray. The tote tray is slightly less than 12" wide and slightly less than 16" long and about 6" high so that the tote trays may be stacked two deep, three wide and several high (depending on the distance between shelves) on a typical 2' by 4' shelf.

BRIEF DESCRIPTION OF THE DRAWINGS

These and other details and advantages of my invention, will be described in connection with the accompanying drawings, which are furnished only by way of illustration and not in limitation of the invention, and in which drawings.

BEST MODE FOR CARRYING OUT THE INVENTION

Figure 1:
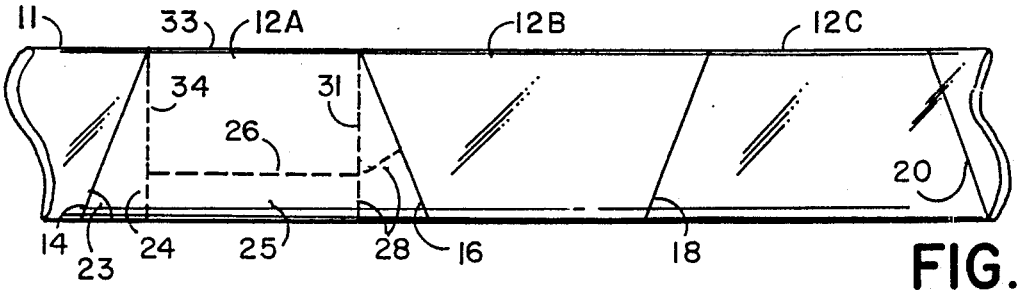
FIG. 1 is a plan view of a tube of sheet plastic laid out for heat sealing and cutting into trapezoidal forms to make the paint bags.

In FIG. 1 a long tube 11 of flexible plastic material, preferably 10 inches in circumference, is flattened and a hot thin linear element (such as a hot wire) or preferably a series of such elements is used to cut and heat seal alternately angled lines transversely across the tube along lines 14, 16, 18 and 20, thereby separating the tube into trapezoidal pieces 12A, 12B and 12C.

Figure 2:
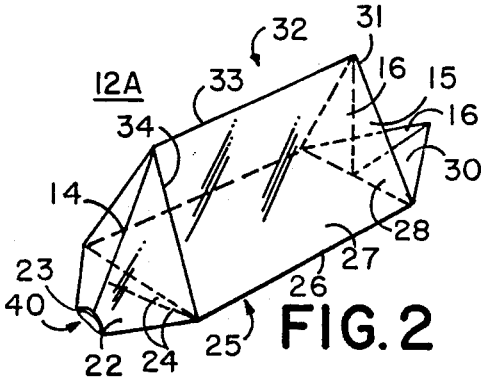
FIG. 2 is a perspective view of the trapezoidal form with the ends crimped to pull out the bottom and create a tent-shaped structure.
Figure 3:
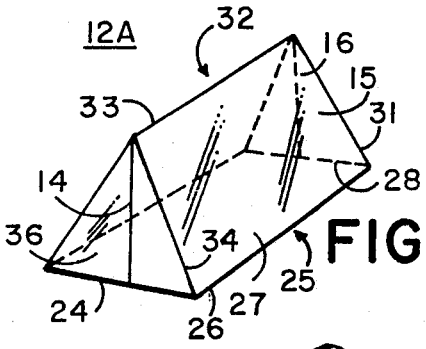
FIG. 3 is a perspective view of the tent-shaped structure with the crimped portions cut off, one end sealed and the other end open to receive the paint.
Figure 4:
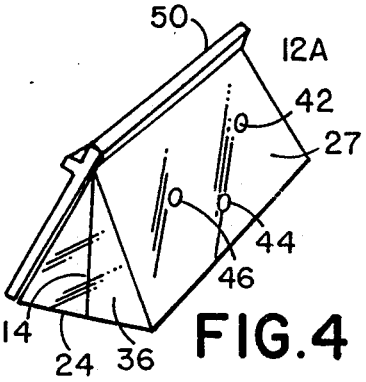
FIG. 4 is a perspective view of the completed disposable paint bag as inserted in a paint applicator and punctured to dispense paint.

In FIG. 2, holding each trapezoidal piece vertically with the long parallel edge at the bottom, each trapezoidal piece 12, which is heat sealed together at each end along lines 14 and 16, has one bottom corner cut off along line 23 and air injected into the trapezoidal piece to inflate it with air. The trapezoidal piece is crimped at the end opposite to the cut end at the bottom to flatten out a triangular horizontal section 30, thereby causing the trapezoidal piece to flare outwardly separating the two sheets at the bottom and creating a tent-shaped structure. A hot wire is then applied at the intersection of the crimped triangular section 30 and the tent-shaped structure along line 28 to seal the end 15 of the tent-shaped structure cutting off the crimped triangular section 30. At the opposite end of the tent-shaped structure the opening 40 formed by cut line 23 is used to fill the trapezoidal piece with paint. The filling takes place in a batch in the tote tray shown in FIG. 7. Then the triangular section 22 is crimped, cut off and heat sealed along bottom line 24, thereby creating a completely sealed disposable paint bag 12A (as seen in FIG. 3). The paint bags in the tote tray are heat sealed a number at a time by a bar heat sealer or series of bar heat sealers along lines 70, 72, 74 and 76 to enclose all of the paint bags. Each paint bag is used in a paint applicator, such as the one described in U.S. Pat. No. 3,918,820. Then the bag is punctured through one side 27 (as in FIG. 4) preferably with three openings 42, 44 and 46 and compressed by a pressure plate 50 or other means to squeeze paint into a paint applying surface, thereby maintaining a steady supply of paint to the pad. When the paint is all used up the bag is thrown away and replaced by a full bag.

Figure 5:
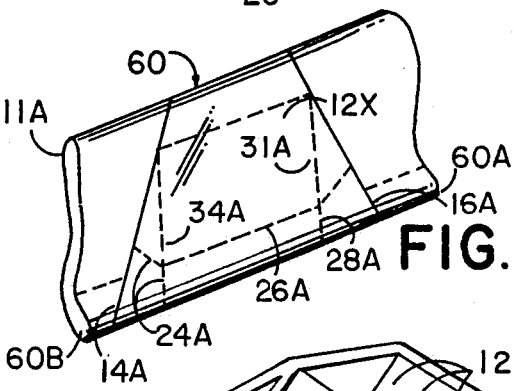
FIG. 5 is a perspective view of a sheet of plastic folded over double showing how the trapezoidal form is heat sealed and cut from the doubled over sheet of plastic.
Figure 6:
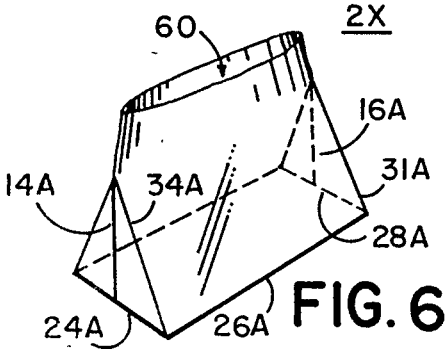
FIG. 6 is a perspective view of the completed refillable paint bag with an opening at the top.

In FIG. 5 an alternate embodiment of the invention is formed from one sheet 11A, preferably 12 inches wide, folded to meet at the top or, as in the Figure, a 12 inch diameter tube cut along the top ridge and the open top ridge of the bag forms a top opening 60 while both ends are crimped and completely heat sealed as side 15 was sealed in the above description, thereby creating a paint bag which is refillable through the top opening 60, as in FIG. 6. By using an enlarged tube cut to form top openings 60, 60A and 60B no material is wasted because the trapezoidal pieces alternate upward and downward orientations. In a folded over version the bottom of the trapezoidal piece must always be downward leaving waste between cut trapezoidal pieces. The paint bag is filled with paint through the top opening 60 and the paint bag is inserted in a paint applicator wherein elements in the paint applicator hold the top of the paint bag close. The paint bag is similarly punctured and the paint squeezed out. When it is empty the paint bag may be refilled.

Figure 7:
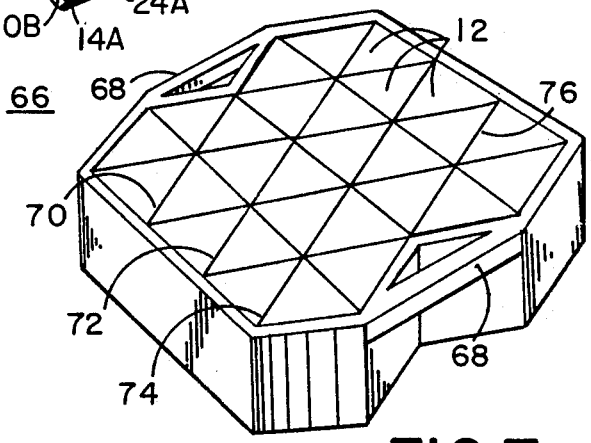
FIG. 7 is a perspective view of a molded tote tray for carrying a number of paint bags.

In FIG. 7 a tote tray 66 is shown as a rigid molded plastic tot tray which is used in filling and sealing the paint bags and as a carrying and display means with shaped compartments for 28 paint bags 12 stacked inside the tray (a total of 3½ gallons of paint). Handles 68 are molded into the tray at each end. Each tote tray is slightly less than 12" wide and 16" long. The tote trays fit conveniently on a retail display shelf with two deep and four across on a standard 2' by 4' shelf.

It is understood that the preceding description is given merely by way of illustration and not in limitation of the invention and that various modifications may be made thereto without departing from the spirit of the invention as claimed.

I claim:

1. A method of making disposable compressible plastic paint bags, wherein the method comprises:

laying out a long flat sheet of compressible plastic material folded over to form a double sheet;

applying hot thin linear elements to the long flat sheet in alternating angles transversely across the long flat sheet along its length to form separate double trapezoidal double thick pieces heat sealed together at each end;

holding each trapezoidal piece vertically with the long parallel edge at the bottom, cutting one bottom corner, injecting air into the trapezoidal piece, crimping each of the two ends of the trapezoidal piece at the bottom to flatten out a triangular section at each end horizontally, thereby causing the trapezoidal piece to flare outwardly separating the two sheets at the bottom and creating a tent-shaped structure;

applying a hot thin heat linear element at the intersection of a crimped triangular section and the tent-shaped structure opposite the cut corner to seal an end of the tent-shaped structure;

filling the tent-shaped structure through the cut corner, crimping the cut end of the trapezoidal piece at the bottom to flatten out a triangular section at the cut end horizontally, and heat sealing the cut corner end of the tent-shaped structure with a hot thin linear element at the intersection of the crimped triangular section and the tent-shaped structure to seal the end of the tent-shaped structure, thereby creating an elongated strip of compressible plastic forming a rectangular bottom and folding upwardly at an acute angle on two long edges of the bottom to form two rectangular sides meeting at a ridge along the top, and triangular segments folded over each end from each side to meet in vertical heat sealed seems forming triangular ends and the triangular ends heat sealed to the bottom to form an enclosed tent-shaped bag for holding paint to be used in a paint applicator wherein the bag is punctured and compressed to squeeze paint into a paint applying surface.

2. The method of claim 1 wherein the bottom and the sides of the paint bag are formed from a tubular sheet of plastic and the top ridge of the bag is closed, thereby providing a disposable paint bag which is discarded when empty.

3. The method of claim 1 wherein the bottom and the sides of the paint bag are formed from one sheet folded to meet at the top and the top ridge of the bag is left open, alternately crimping and heat sealing both ends of the trapezoidal piece, filling the trapezoidal piece with paint through the open top ridge, and sealing the top ridge of the bag by elements in the paint applicator holding the top of the paint bag closed, thereby creating a reusable paint bag which may be refilled.

4. The method of claim 1 further comprising placing a number of the trapezoidal pieces with cut corners facing upwardly in a plastic molded tote tray having tent-shaped compartments to receive a number of the paint bags and gang filling a number of the trapezoidal pieces simultaneously and then using a heat bar to seal a number of the trapezoidal pieces simultaneously to form sealed paint bags, and using the same molded tote tray to transport and display the sealed paint bags.

* * * * *